US006177759B1

(12) United States Patent
Beeteson et al.

(10) Patent No.: US 6,177,759 B1
(45) Date of Patent: Jan. 23, 2001

(54) SPACER, SUPPORT, GRID AND ANODE DESIGN FOR A DISPLAY DEVICE COMPENSATING FOR LOCALIZED VARIATIONS IN THE EMISSION OF ELECTRONS

(75) Inventors: John Beeteson; Andrew Ramsay Knox, both of Ayrshire (GB)

(73) Assignee: International Business Machines Corporation, Armonk, NY (US)

( * ) Notice: Under 35 U.S.C. 154(b), the term of this patent shall be extended for 0 days.

(21) Appl. No.: 09/075,587

(22) Filed: May 11, 1998

(30) Foreign Application Priority Data

Jun. 12, 1997 (GB) ..... 9712139

(51) Int. Cl.[7] ..... H01J 29/70; H01J 1/62; H01J 63/04

(52) U.S. Cl. ..... 313/422; 313/431; 313/495; 313/496; 313/497

(58) Field of Search ..... 313/421, 422, 313/426, 431, 433, 442, 458, 238, 281, 286, 288, 292, 293–95, 308, 310, 495, 496, 497; 220/445

(56) References Cited

U.S. PATENT DOCUMENTS 5,504,385 * 4/1996 Jin et al. ..... 313/309 X
5,589,728 * 12/1996 Levine et al. ..... 313/309 X
5,864,205 * 1/1999 Dworsky ..... 313/281 X
5,889,363 * 3/1999 Beeteson et al. ..... 313/495
6,008,573 * 12/1999 Beeteson et al. ..... 313/422

FOREIGN PATENT DOCUMENTS

2304981 * 3/1997 (GB) .

* cited by examiner

*Primary Examiner*—Nimeshkumar D. Patel
*Assistant Examiner*—Mack Haynes
(74) *Attorney, Agent, or Firm*—Jay P. Sbrollini; Louis P. Herzberg

(57) ABSTRACT

A display device comprises a substrate, cathode means for emitting electrons, a permanent magnet and one or more supports between the substrate and the magnet. A two dimensional array of channels extends between opposite poles of the magnet, the magnet generating, in each channel, a magnetic field for forming electrons from the cathode means into an electron beam. A screen receives an electron beam from each channel, the screen having a phosphor coating facing the side of the magnet remote from the cathode, the phosphor coating comprising a plurality of pixels each corresponding to a different channel. Grid electrode means is disposed between the cathode means and the magnet for controlling flow of electrons from the cathode means into each channel, the grid electrode means having a plurality of apertures, each aperture corresponding to one of the channels. The apertures are of varying cross-section in the vicinity of the supports such that localized variations in the emission of electrons by the cathode means caused by the one or more supports is compensated. The display also has one or more spacers between the screen and the magnet and anode means disposed on the surface of the magnet remote from the cathode for accelerating electrons through the channels. The anode means is of varying shape in the vicinity of the spacers such that localized variations in the electron beam shape and position caused by the one or more spacers is compensated.

14 Claims, 7 Drawing Sheets

SPACER, SUPPORT, GRID AND ANODE DESIGN FOR A DISPLAY DEVICE COMPENSATING FOR LOCALIZED VARIATIONS IN THE EMISSION OF ELECTRONS

FIELD OF THE INVENTION

The present invention relates to a magnetic matrix display device and more particularly to spacers, supports, grid and anode electrodes for use in such a display.

BACKGROUND OF INVENTION

A magnetic matrix display of the present invention is particularly although not exclusively useful in flat panel display applications such as television receivers and visual display units for computers, especially although not exclusively portable computers, personal organizers, communications equipment, and the like.

Conventional flat panel displays, such as liquid crystal display panels and field emission displays, are complicated to manufacture because they each involve a relatively high level of semiconductor fabrication, delicate materials, and high tolerances.

GB Patent Application 2304981 discloses a magnetic matrix display having a cathode for emitting electrons, a permanent magnet with a two dimensional array of channels extending between opposite poles of the magnet, the direction of magnetisation being from the surface facing the cathode to the opposing surface. The magnet generates, in each channel, a magnetic field for forming electrons from the cathode means into an electron beam. The display also has a screen for receiving an electron beam from each channel. The screen has a phosphor coating facing the side of the magnet remote from the cathode, the phosphor coating comprising a plurality of pixels each corresponding to a different channel.

The magnetic matrix display uses a thick glass for the screen and backplate in order to ensure that a self supporting structure can be obtained when the glass envelope is evacuated. The thickness of glass required to provide this self supporting structure effectively limits this type of design to screen diagonals up to about 24 inches (610 mm).

To allow screen sizes with a larger than 24 inch (610 mm) diagonal, or to allow the thickness of the glass and hence the weight of the display to be reduced, thinner glass must be used. This requires the use of front spacers and back supports to withstand the atmospheric pressure on the outside of the glass envelope due to the vacuum within the glass envelope. Such spacers and supports can be designed, but the permittivity of an insulating support modifies the position of the remote cathode and changes the electron density in the vicinity of the support. This effects grid cutoff and the emission of electrons. The permittivity of an insulating spacer modifies the electrostatic field patterns in the vicinity of the spacer or of the support and hence will change the shape and/or direction of the electron beam.

Thus a visible pattern will appear on the screen at the locations where the spacers or the supports are located. If one component (spacer or support) is used between every pixel of the screen, then such visible patterning will not cause a problem, since it will be consistent across the whole area of the screen. In a practical design, such spacers and supports are positioned at intervals of about 10 mm and so the patterning can be discerned in the screen image generated by the display.

SUMMARY OF THE INVENTION

In accordance with the present invention, there is now provided a display device comprising: a substrate; cathode means for emitting electrons, a permanent magnet; one or more supports between said substrate and said magnet; a two dimensional array of channels extending between opposite poles of the magnet; the magnet generating, in each channel, a magnetic field for forming electrons from the cathode means into an electron beam; a screen for receiving an electron beam from each channel, the screen having a phosphor coating facing the side of the magnet remote from the cathode, the phosphor coating comprising a plurality of pixels each corresponding to a different channel; grid electrode means disposed between the cathode means and the magnet for controlling flow of electrons from the cathode means into each channel, said grid electrode means having a plurality of apertures, each aperture corresponding to one of said channels, said apertures being of varying cross-section in the vicinity of the supports such that localized variations in the emission of electrons by the cathode means caused by said one or more supports is compensated.

The variation in cross-section of the apertures allows any shift in remote cathode position and change in electron density in the vicinity of the support to be compensated. This compensation may be by means of variation in the diameter of the apertures, or by variation in the shape of the apertures. Typically the apertures located nearest to the spacers are non-circular in shape, and preferably elliptical.

In a preferred embodiment, said cathode means for emitting electrons comprises an extraction grid; and said one or more supports between said substrate and said magnet are positioned so as to support the extraction grid. This allows the spacer to perform a second function, thereby eliminating the need for a separate support for the extraction grid. Also, in a preferred embodiment, said cathode means for emitting electrons comprises thermionic cathode filaments; and said one or more supports between said substrate and said magnet are positioned so as to support the thermionic cathode filaments. This allows the spacer to perform a third function, thereby eliminating the need for a separate support for the thermionic cathode filaments.

In a further preferred embodiment, the display further comprises one or more spacers between said screen and said magnet; and anode means disposed on the surface of the magnet remote from the cathode for accelerating electrons through the channels, said anode means being of varying shape in the vicinity of the spacers such that localized variations in the electron beam shape and position caused by said one or more spacers is compensated.

The varying shape of the anode means in the vicinity of the spacer allows any variation of the electrostatic field patterns in the vicinity of the spacer and hence change in the shape of direction of the electron beam to be compensated.

Preferably, said one or more supports between said substrate and said magnet and said one or more spacers between said screen and said magnet have a low conductivity such that charge accumulation is prevented. In a preferred embodiment, said one or more supports between said substrate and said magnet and said one or more spacers between said screen and said magnet are glass ceramic.

BRIEF DESCRIPTION OF THE DRAWINGS

Preferred embodiments of the present invention will now be described, by way of example only, with reference to the accompanying drawings in which.

DESCRIPTION OF THE PREFERRED EMBODIMENTS

Figure 1:
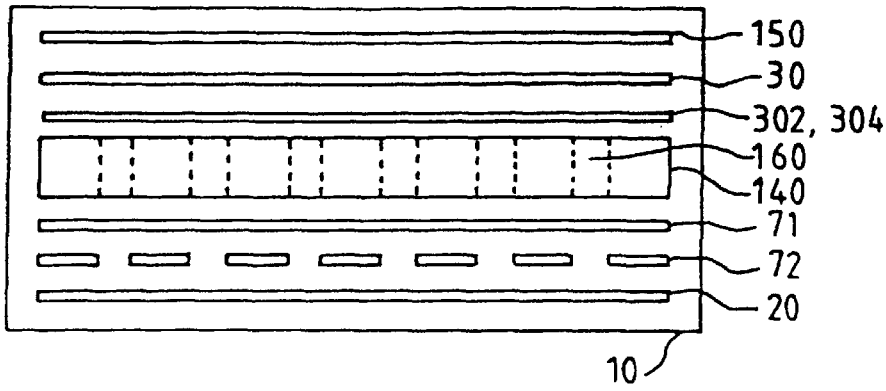
FIG. 1 PRIOR ART
FIG. 1 is a simplified cross-sectional view of an example of a prior art Magnetic Matrix Display device.

Referring to FIG. 1, an example of a magnetic matrix display device 10 comprises a plane cathode 20 facing a plane anode 30. A phosphor coating 150 is disposed on the side of the anode 30 remote from the cathode. A permanent magnet 140 is disposed between the anode 30 and the cathode 20. The magnet 140 is perforated by a two dimensional matrix of channels 160. A grid assembly is disposed between the magnet 140 and the cathode 20. The grid assembly comprises first and second electrically isolated arrays of parallel conductors hereinafter referred to as first grids 71 and second grids 72 respectively. The first grids 71 are arranged orthogonally to the second grids 72 to form a lattice pattern. Apertures are formed in the first grids 71 and the second grids 72. The apertures are located at each intersection of a first grid 71 and a second grid 72. Each aperture is aligned with a different channel 160. The phosphor coating comprises a plurality of pixels each corresponding to a different channel. In a colour magnetic matrix display, each of the corresponding phosphor pixels may be a group of phosphor elements, each group corresponding to a different channel and each group typically comprising a Red, a Green and a Blue phosphor element. Deflection anodes 302, 304 are arranged as a pair of combs between the magnet 140 and the anode 30 to sequentially address electron beams emerging from the channels to different ones of the phosphor elements.

Figure 2:
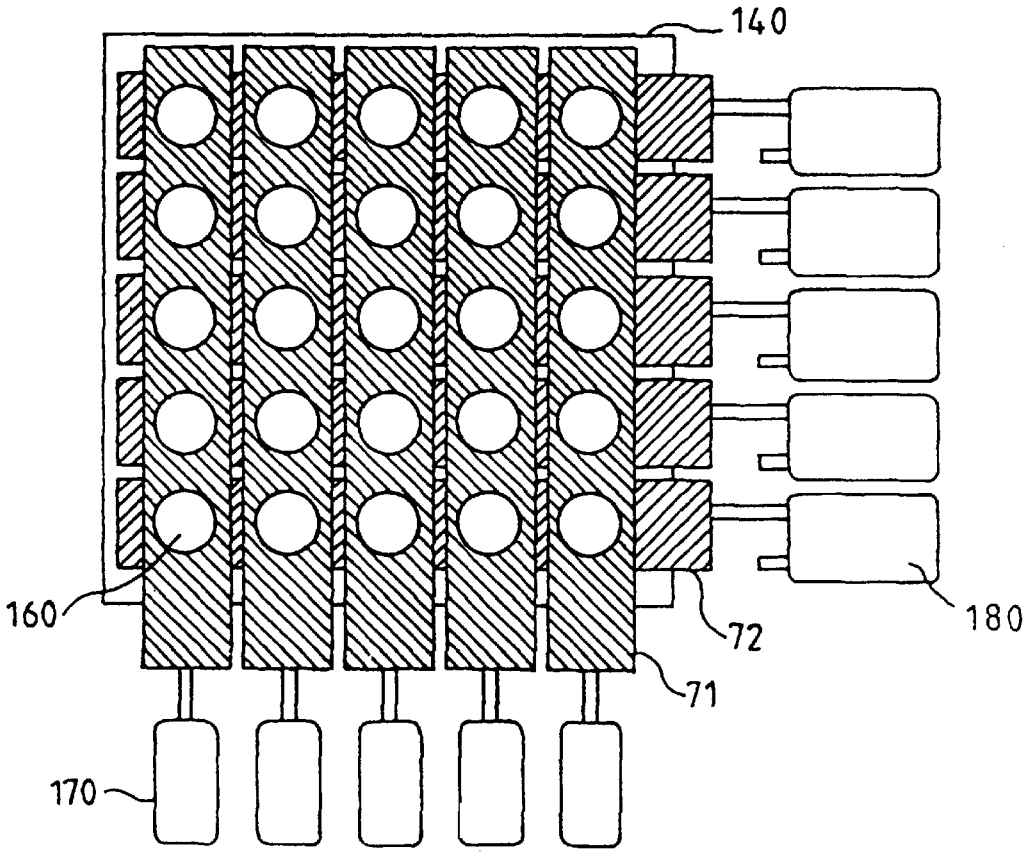
FIG. 2 PRIOR ART
FIG. 2 is a cutaway plan view of the example of FIG. 1.

Referring to FIG. 2, column drive circuitry 170 is connected to the first grids 71. Row drive circuitry 180 is connected to the second grids 72. This has the advantage that for a conventional display having a four to three aspect ratio, with more columns than rows, the number of more complex expensive analog drivers is reduced at the cost of having more simple, cheap digital switches. Referring back to FIG. 1, in operation, the anode 30 is held at a higher potential than the cathode 20. Electrons emitted from the cathode 20 are thus accelerated towards the anode 30. As electrons enter each of the channels 160 in the magnet 140 they are collimated into a dense beam by the magnetic field therein. In operation, admittance of electrons to the channels is selectively controlled via the grid assembly. Each channel 160 is addressable by appropriate voltage signals applied by the row drive circuitry 180 and the column drive circuitry 170 to the corresponding first grid 71 and second grid 72. Electrons are thus selectively admitted or blocked from entering each channel 160, passing through the magnet 140 and reaching the corresponding region of the phosphor coating 150 to generate a pixel of a displayed image on the screen. The pixels of the displayed image are scanned in a refresh pattern. To produce the refresh pattern, a column of pixels is energized by applying an appropriate voltage, via the row drive circuitry 180 to the corresponding second grid 72 with the voltage on the first grids 71 set via the column drive circuitry 170 so that no beam current flows. The voltages on the remaining first grids 72 are set by the column drive circuitry 170 so that no beam current flows for any operating voltage on the second grids 71. The voltages on the second grids 72 are then modulated by row drive circuitry 180 as a function of input video data corresponding to the energized column of pixels. The process is then repeated for the next successive column. The row and column functions are transposed relative to that conventionally used in LCDs, that is the rows are driven by an analog voltage and the columns are switched between two analog levels, however such transposition is not an essential feature of a magnetic matrix display.

Figure 3:
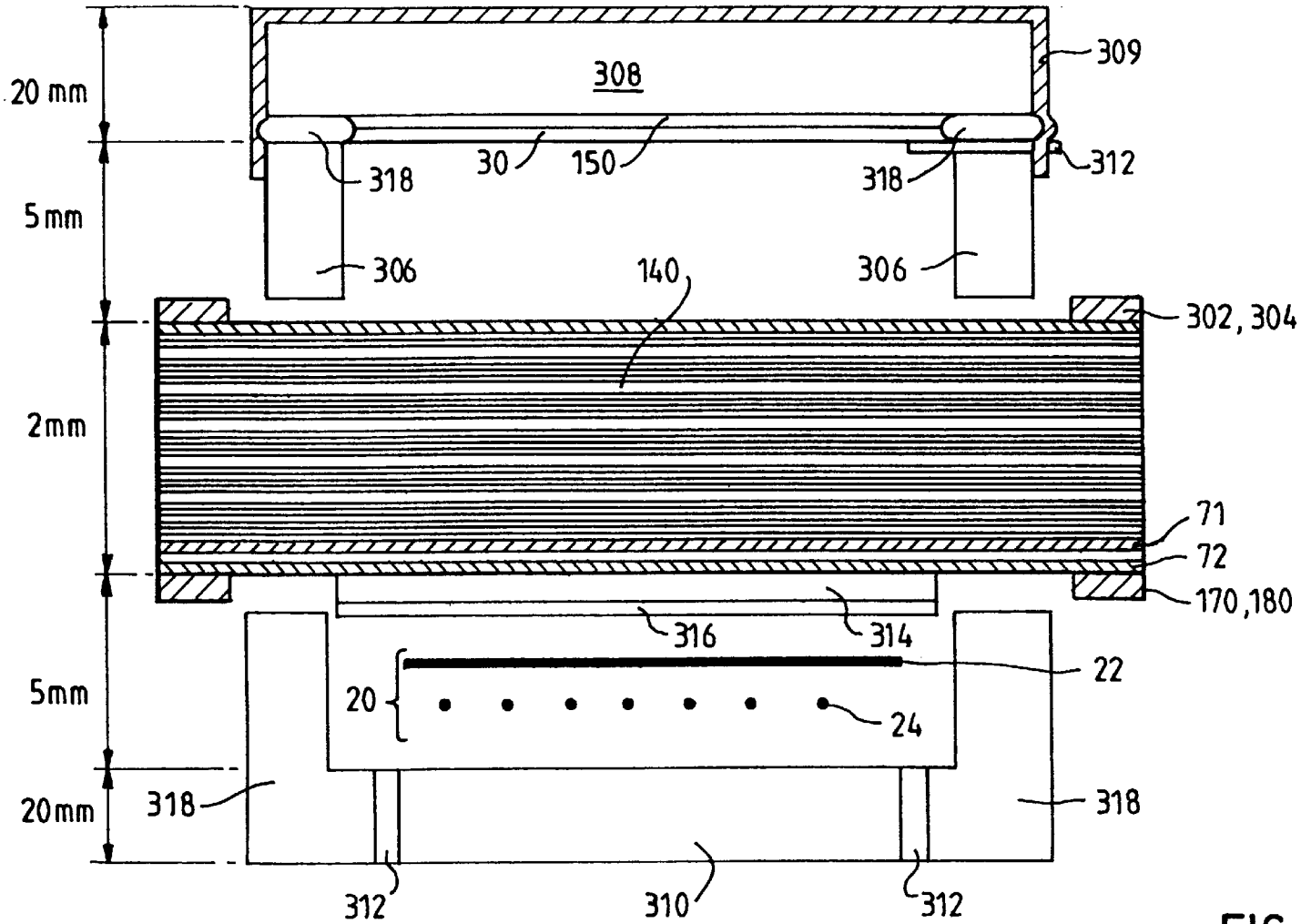
FIG. 3 PRIOR ART
FIG. 3 is a simplified cross-sectional view of a prior art practical Magnetic Matrix Display device.

FIG. 3 shows an exploded view of a prior art construction of a magnetic matrix display device. The magnet 140, first 71 and second 72 grids and deflection anodes 302,304 are shown at the center together with the driver circuits 170,180 for the first 71 and second 72 grids. The magnet 140 is of the order of 2 mm thick. A metallized grid stand off is attached to the lower face of the magnet. The stand off comprises an insulating layer 314 having a thin metallized coating 316.

On the side of the magnet having the metallized grid stand off is a substrate glass 310 on which the display device is mounted. The substrate glass 310 has exhaust holes 312 for evacuating the completed glass envelope. The substrate glass 310 is typically 20 mm thick so that the substrate is self supporting when the display structure is evacuated. The substrate glass 310 is separated from the magnet 140, grids 71,72 and deflection anodes 302,304 by lower glass side supports 318 formed with the substrate glass 310. These lower side supports 318 are of the order of 5.5 mm high and provide a separation between the glass substrate 310 and the grid stand off in which a cathode 20 is located. The cathode consists of cathode filaments 24 and an extraction grid 22.

On the side of the magnet away from the metallized grid stand off is the screen glass 308, on which the phosphor coating 150 and the aluminium backing forming the anode 30 is located. This screen glass is also typically 20 mm thick so that the screen glass is self supporting when the display structure is evacuated. The screen glass 308 is separated from the magnet 140, grids 71,72 and deflection anodes 302,304 by upper glass side supports 306. These upper side supports 306 are of the order of 5 mm high. Between the upper side supports 306 and the screen glass is a glass frit seal 318. A connection 312 to the anode 30 passes through the glass envelope at the glass frit seal 318 to allow a connection to be made. An anti-reflective coated implosion protection film 309 is present on the front surface of the screen glass.

Figure 4:
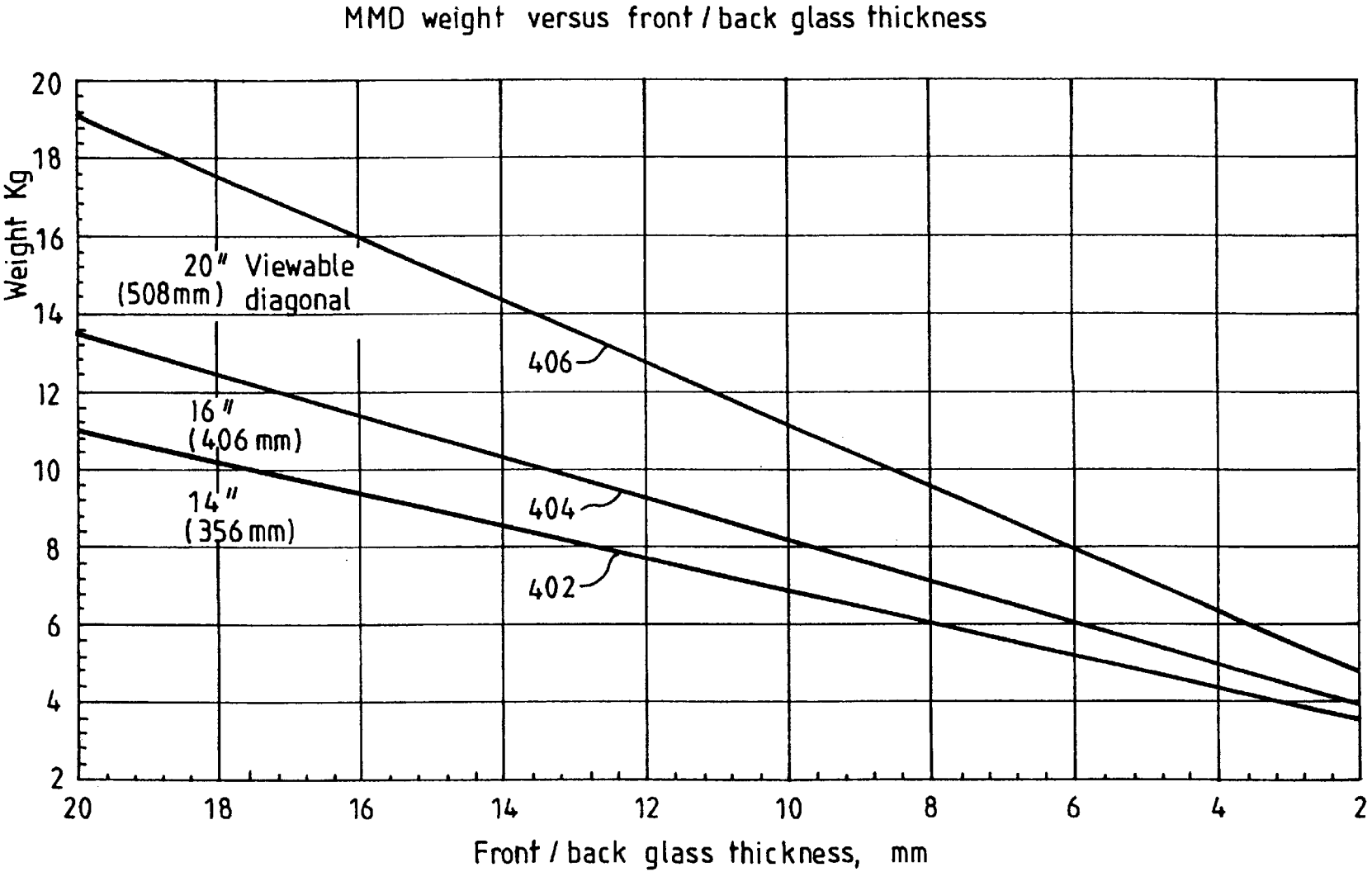
FIG. 4 is a graph of display weight versus glass thickness for varying prior art viewable diagonal sizes of screen.

FIG. 4 shows a graph of the magnetic matrix display weight versus minimum thickness of glass used for the substrate and screen glass for varying sizes of display screen. Line 402 corresponds to a 14" (356 mm) viewable diagonal magnetic matrix display. Lines 404 and 406 correspond to 16" (406 mm) and 20" (508 mm) viewable diagonal magnetic matrix displays respectively. As an example, for a 15" (381 mm) display, glass having a thickness of between 12 and 14 mm is needed. Such a display weighs between 7 and 8 Kg. For a 21" (533 mm) display, the required thickness increases to around 20 mm. Such a display weighs about 14 Kg. For a display of this size, with this thickness of glass, the weight is significant. Additionally, the thickness of glass usable reaches an upper limit because optical distortions occur which give an image a concave or "dished" appearance. In practice, about 24" viewable diagonal is the limit for a flat screen display device with an unsupported glass faceplate.

Figure 5:
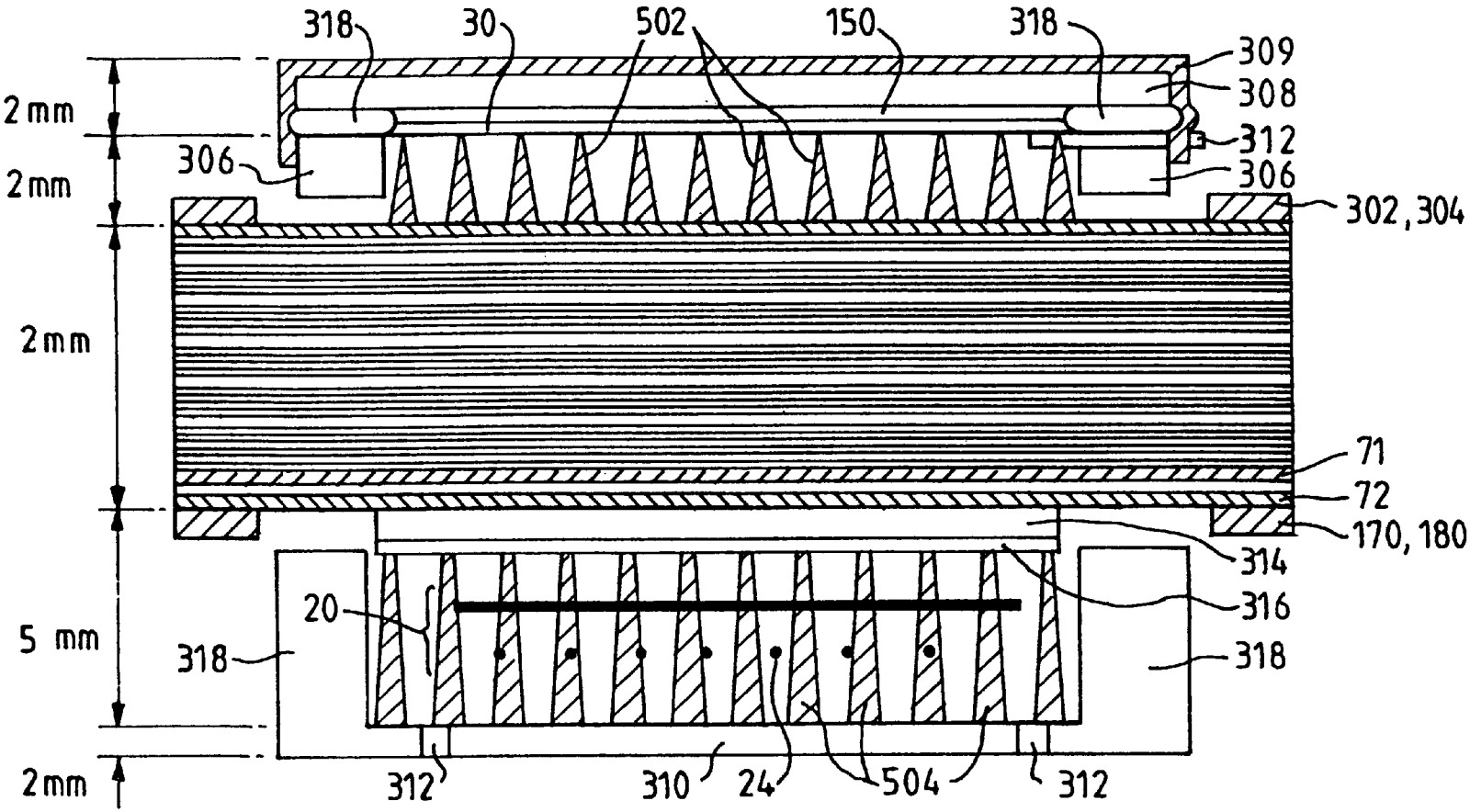
FIG. 5 is a simplified cross-sectional view of a practical Magnetic Matrix Display device according to the present invention.

FIG. 5 is a simplified cross-sectional view of a practical Magnetic Matrix Display device according to the present invention. Compared with FIG. 3, the screen glass 308 is reduced in thickness from 20 mm to 2 mm. Any reduction in thickness from the typical 20 mm of the prior art may be used, but reducing the glass thickness to 2 mm utilizes, to best advantage, the present invention. The substrate glass is similarly reduced in thickness to 2 mm. This may also be any thickness, but 2 mm is chosen to utilize, to best advantage, the present invention. The spacing between the magnet and the aluminium backing to the phosphors is reduced from 5 mm to 2 mm. Again, this dimension may be varied without departing from the present invention.

Figure 7:
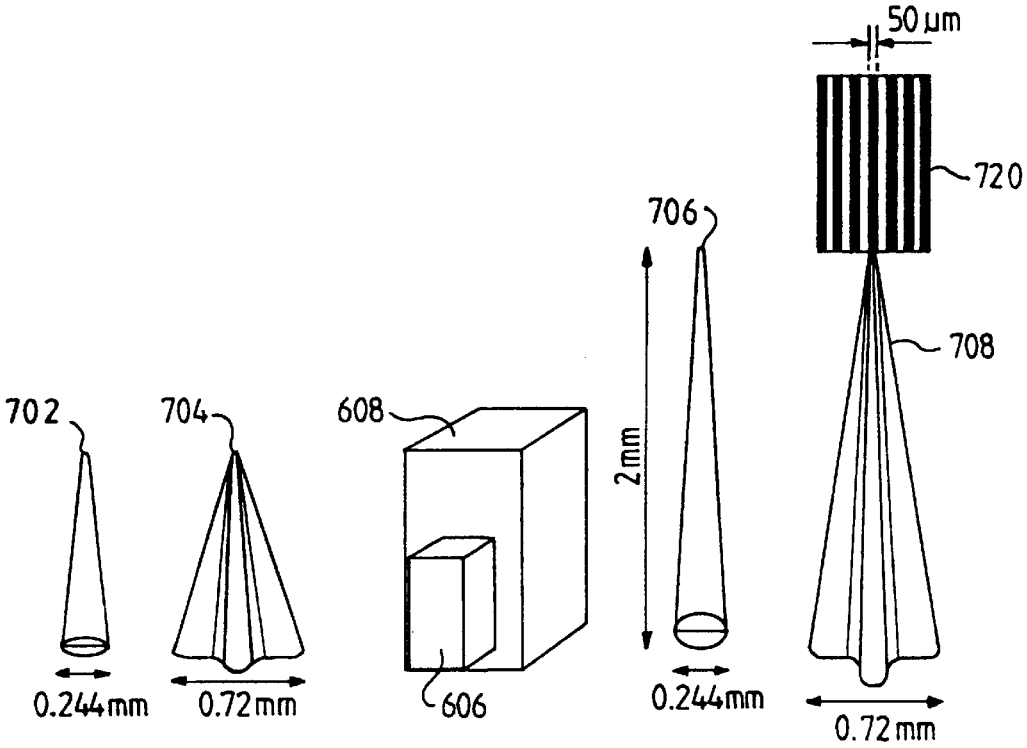
FIG. 7 is a view of spacers according to the present invention.
Figure 8:
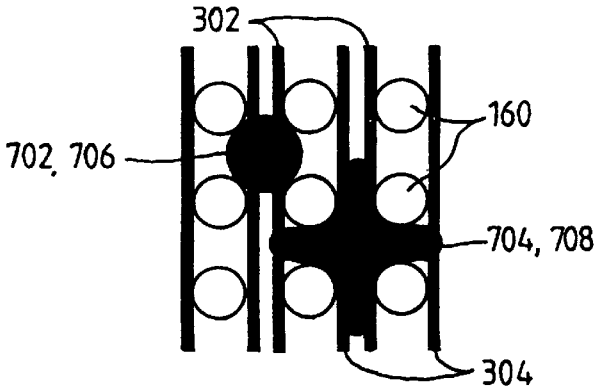
FIG. 8 is a view of a spacer located on the magnet surface.
Figure 9:
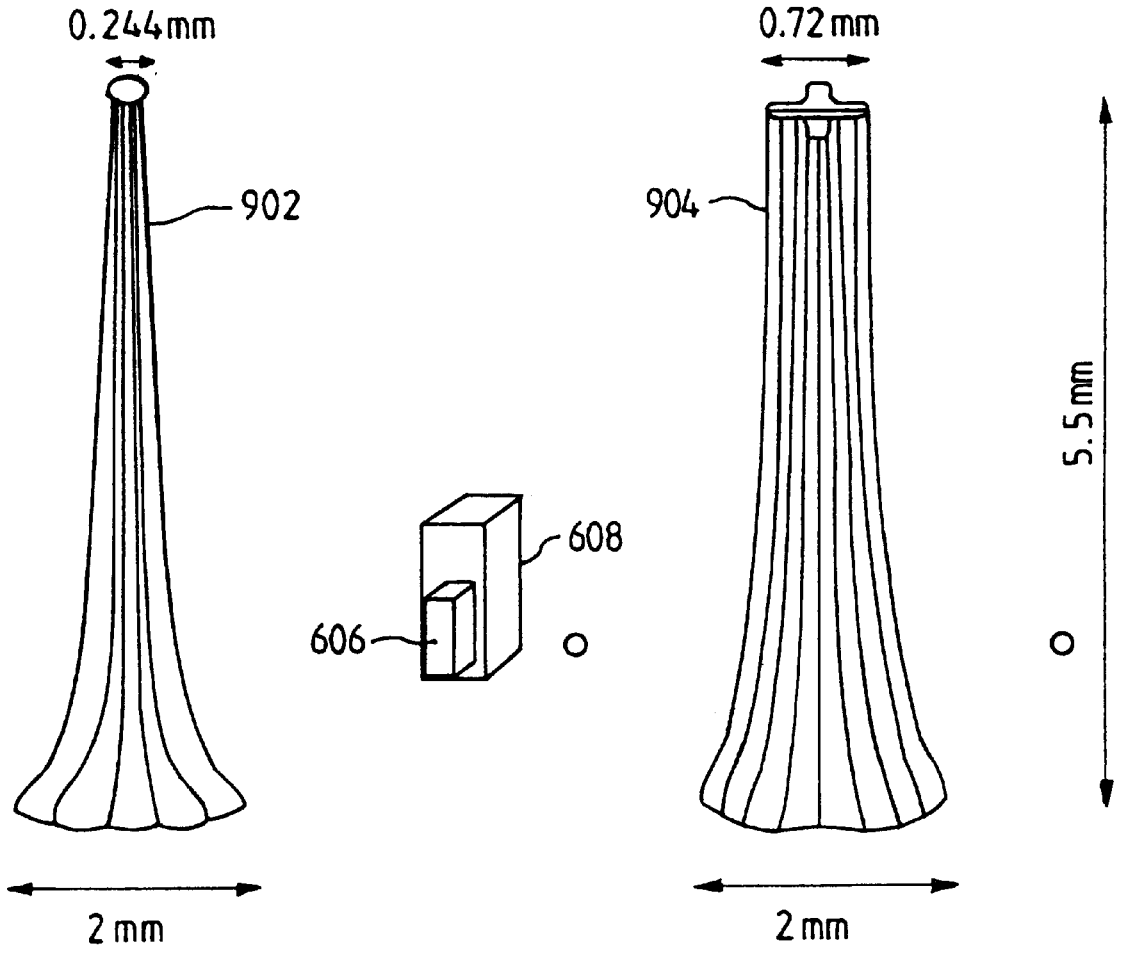
FIG. 9 is a view of back supports according to the present invention.

Conical spacers 502 are used to separate the magnet 140 assembly from the faceplate glass 308 and to withstand the atmospheric pressure on the outside of the glass envelope due to the vacuum within the glass envelope. Similarly back supports 504 are used to separate the magnet 140 assembly from the substrate glass 310 and to withstand the atmospheric pressure on the outside of the glass envelope due to the vacuum within the glass envelope. The use of the conical spacers 502 and the back supports 504 allows the use of thinner glass for the screen glass 308 and for the substrate glass 310. The front spacers and back supports shown in FIG. 5 are not to scale and are illustrative of location between the magnet and the glass faceplate and substrate. The front spacers are typically positioned about 10 mm apart in a preferred embodiment. The back spacers are also typically positioned about 10 mm apart in a preferred embodiment. The size of the front spacers and back supports is shown in FIGS. 7 and 9 respectively. The location of the spacers relative to the channels in the magnet is shown in FIG. 8.

Figure 6:
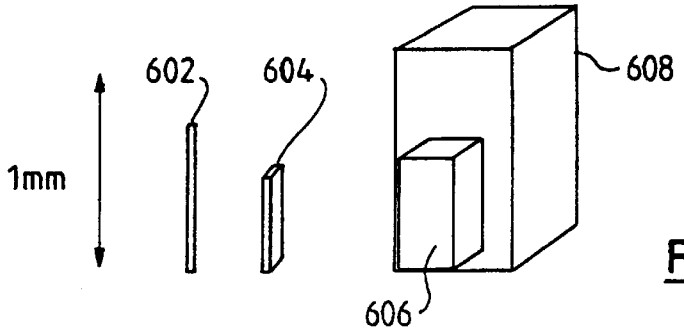
FIG. 6 is a view of spacers according to the prior art.

FIG. 6 shows front screen spacers used in prior art Field Emission Displays (FEDs). At 602 is shown a FED spacer made by Micron having a length of about 0.7 mm and a diameter of about 0.03 mm. At 604 is shown a FED spacer made by Candescent having a length of about 0.5 mm and a cross-section of about 0.1 mm by 0.2 mm. Also shown in FIG. 6 for comparison are two standard size SMT elements. At 606 is shown a 201 sized SMT which has a height of 20 thou (0.5 mm) and a cross section of 10 thou (0.25 mm) by 10 thou (0.25 mm). At 608 is shown a 402 sized SMT which has a height of 40 thou (1 mm) and a cross section of 20 thou (0.5 mm) by 20 thou (0.5 mm).

FIG. 7 shows spacers according to the present invention. At 702 is shown a conical spacer having a length of about 1 mm and a maximum diameter of 0.244 mm. At 704 is shown an alternative design of spacer in the shape of a star. This spacer has a length of about 1 mm and a maximum diameter of 0.72 mm. At 706 is shown a conical spacer having a length of about 2 mm and a maximum diameter of 0.244 mm. At 708 is shown an alternative design of spacer in the shape of a star. This spacer has a length of about 2 mm and a maximum diameter of 0.72 mm. At 720 is shown, to scale, the phosphor/black matrix pattern on the screen. The tip of the spacer must fit onto the black matrix area, which in 720 is shown as 50 $\mu$m wide.

The spacers according to the present invention of FIG. 7 are relatively large compared with those of the prior art of FIG. 6. They may be relatively easily manufactured out of ceramic or glass. Placement of the spacers in the display is a technology which is well known in the art for use with spacers for FEDs.

FIG. 8 shows the positioning of the spacers when viewing the magnet 140 surface. The individual channels 160 of the magnet can be seen, together with the deflection anodes 302,304. In FIG. 8, both a conical spacer such as 702 or 706 from FIG. 7 and a star-shaped spacer such as 704 or 708 from FIG. 7 are shown. In a practical display, in general, both types of spacer would not be used in the same display. Additionally, the pitch between the spacers would be greater than that shown. The channels 160 shown are on a 300 $\mu$m pitch and are 180 $\mu$m in diameter. The tips of the spacers can be seen located on the surface of the magnet 140 between the channels 160.

FIG. 9 shows back supports according to the present invention. At 902 is shown a star shaped back support having a length of about 5.5 mm, a maximum diameter of 2 mm and a minimum diameter of 0.244 mm. Also shown for comparison are the 201 sized SMT 606 and the 402 sized SMT 608 of FIG. 6. At 904 is shown a star shaped back support having a length of about 5.5 mm, a maximum diameter of 2 mm and a minimum diameter of 0.72 mm. At the point of minimum diameter, the spacer is still star shaped, rather than being circular.

Figure 10:
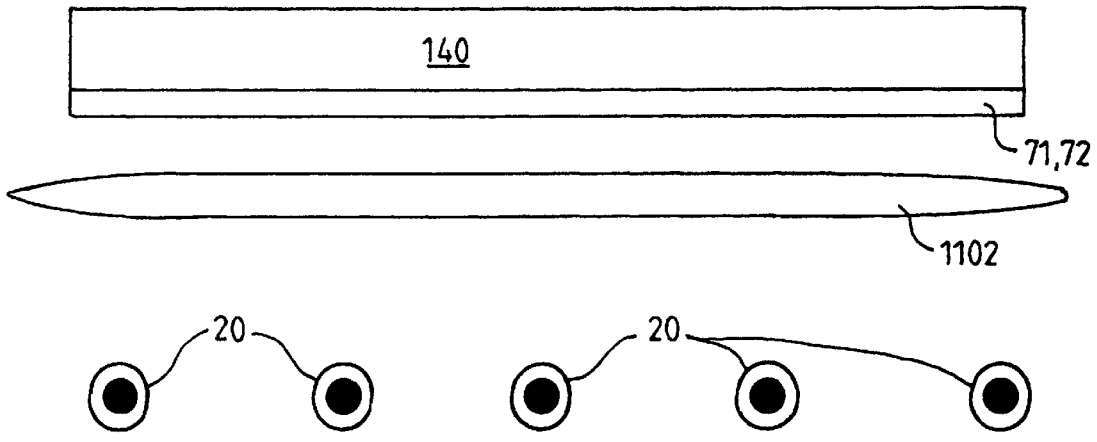
FIG. 10 shows a prior art thermionic remote virtual cathode used in a Magnetic Matrix Display.

The effect of the back support on the electrostatic field will now be explained. FIG. 10 shows a prior art remote cathode used in a magnetic matrix display. The cathode may be of a thermionic or of a cold cathode type. The example of FIG. 10 shows a thermionic cathode in cross section. Electrons are extracted by a grid (22 in FIG. 5, not shown in FIG. 10) above an array of filaments 20. The extracted electrons cycle between a position close to the magnet 140 and the rear glass substrate. The result is a plane of low velocity electrons close to the control grids on the magnet. The distance of this plane of electrons from the control grids and the density of the electrons in the plane are parameters which affect the cut off voltage set on the first grids 71, and the electron beam pixel current set by the second grids 72 voltage.

The rear supports added between the magnet and the rear glass substrate have two effects:

1. The physical obstruction of the support will cause some electrons to be lost;
2. The permittivity will change the local electrostatic field potential and cause a local variation in electron position and density. The typical spacer is made of a glass ceramic material and has a permittivity of 5.

Figure 11:
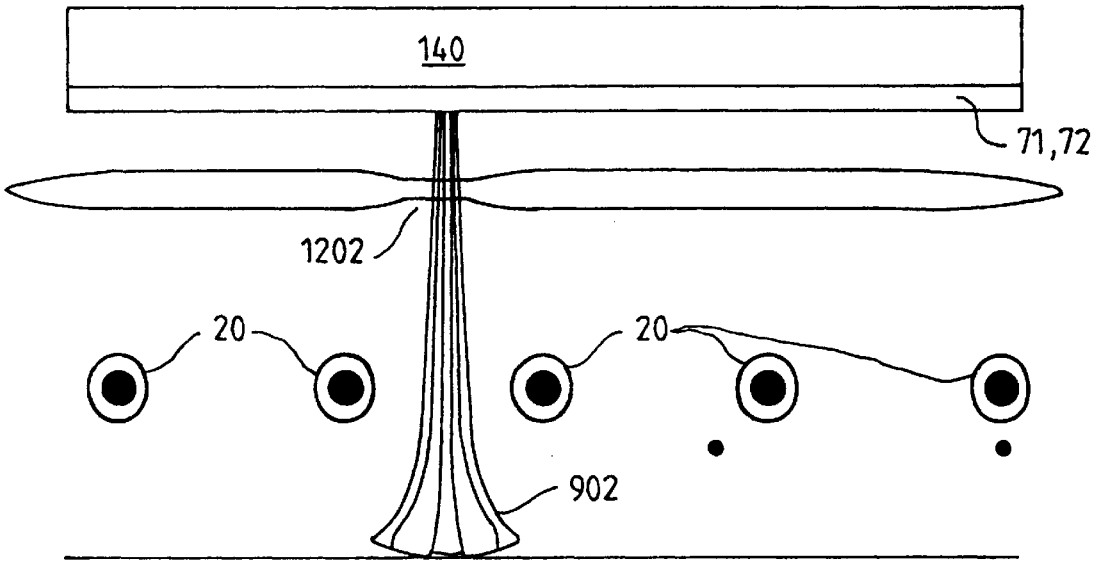
FIG. 11 shows the effect of a back support on cathode position and electron density.

The exact disturbance which occurs is difficult to predict, but the disturbance itself is repeatable for any given structure. FIG. 11 shows a typical result, including the shift in remote cathode position and the change in electron density.

In the applicants co-pending GB Patent Application 9711744.4 (Attorney Docket Reference UK9-97-001) is disclosed that the cut off voltage and the gain of each pixel can be controlled by the first grid 71 and second grid 72 aperture diameter. These aperture diameters can be different from the aperture diameter in the magnet. Typically, the second grid 72 aperture is slightly larger in diameter than the magnet 140 aperture and the first grid 71 aperture is slightly larger than the second grid 72 aperture. The sizes of each or both of these aperture diameters may be increased or decreased in the regions surrounding a support by small amounts in order to equalise the cut off and gains to an appropriate value. Since the disturbance effect of the rear support decreases as we move further away from the support, then the aperture diameters would gradually revert back to the nominal diameters. So the present invention provides for modification of the first grid 71 and second grid 72 aperture diameters in a progressive manner around a support. The support can also be used to hold the virtual cathode extraction grid 22.

Figure 12:
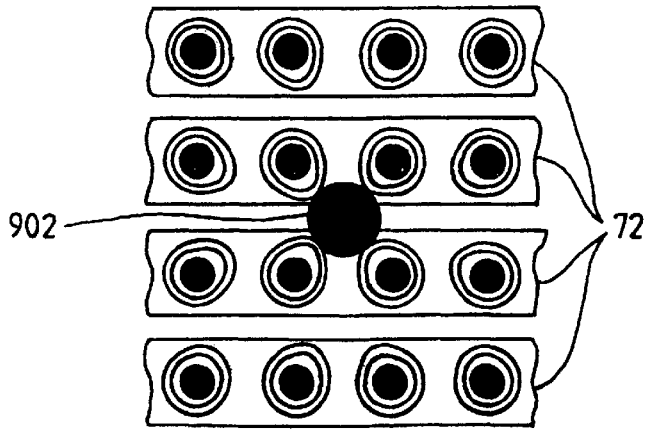
FIG. 12 shows the varying grid holes according to the present invention in the vicinity of the back support.

In a variation of the present invention the first grid 71 and second grid 72 aperture diameters are not circular, but vary around the support. For example, the holes near to the support may be elliptical or "egg" shaped. FIG. 12 shows how the grid hole shape varies in a preferred embodiment of the present invention. The precise details of the hole shape, size and pattern for any particular application have to be determined by simulation and experimentation.

The effect of the front support on the electrostatic field will now be explained. In the magnet 140 to screen 150 area an electron exits from a pixel well or channel and passes through an electron lens formed by the EHT voltage on the final anode 30, the deflection anode 302,304 voltage and the permittivity of the magnetic material, before hitting the phosphors on the screen. A spacer placed between the magnet 140 and the screen 150 must be physically designed so as not to obstruct the electron beam. However, the permittivity of the spacer component, typically 5, will cause a change to the beam shape and position due to the effect on the electrostatic fields. In addition, although the resistance of the spacer will be high, to avoid charge build up, there must be some finite level of conductivity. The resistance of such a slightly conductive spacer will vary with cross sectional area, further complicating the field pattern.

The shape and position of the electron beam can be controlled by the precise design of the deflection anodes around the pixels. The shape of the deflection anodes 302,304 may be modified in the region of the spacer in a progressive manner in such a way as to counter the effects of the material permittivity.

What is claimed is:

1. A display device comprising: a substrate; cathode means for emitting electrons on one side of the substrate; a permanent magnet on the opposite side of the cathode means from the substrate; one or more supports between said substrate and said magnet; a two dimensional array of channels extending between opposite poles of the magnet; the magnet generating, in each channel, a magnetic field for forming electrons from the cathode means into an electron beam; a screen for receiving an electron beam from each channel, the screen having a phosphor coating facing the side of the magnet remote from the cathode, the phosphor coating comprising a plurality of pixels each corresponding to a different channel; and grid electrode means disposed between the cathode means and the magnet for controlling flow of electrons from the cathode means into each channel, said grid electrode means having a plurality of apertures, each aperture corresponding to one of said channels, said apertures being of varying cross-section in the vicinity of the supports such that localized variations in the emission of electrons by the cathode means caused by said one or more supports is compensated.

2. A display device as claimed in claim 1 wherein said variation in cross-section of said apertures is a variation in the diameter of the apertures.

3. A display device as claimed in claim 1 wherein said variation in cross-section of said apertures is a variation in the shape of the apertures.

4. A display device as claimed in claim 3 wherein the shape of apertures in the vicinity of the one or more supports is non-circular.

5. A display device as claimed in claim 3 wherein the shape of apertures in the vicinity of the one or more supports is elliptical.

6. A display device as claimed in claim 1 wherein: said cathode means for emitting electrons comprises an extraction grid; and said one or more supports between said substrate and said magnet are positioned so as to support the extraction grid.

7. A display device as claimed in claim 1 wherein: said cathode means for emitting electrons comprises thermionic cathode filaments; and said one or more supports between said substrate and said magnet are positioned so as to support the thermionic cathode filaments.

8. A display device as claimed in claim 1 wherein said one or more supports between said substrate and said magnet are substantially insulating.

9. A display device as claimed in claim 8 wherein said one or more supports between said substrate and said magnet have a low conductivity such that charge accumulation is prevented.

10. A display device as claimed in claim 8 wherein said one or more supports between said substrate and said magnet are glass ceramic.

11. A display device as claimed in claim 1 further comprising one or more spacers between said screen and said magnet; and anode means disposed on the surface of the magnet remote from the cathode for accelerating electrons through the channels, said anode means being of varying shape in the vicinity of the spacers such that localized variations in the electron beam shape and position caused by said one or more spacers is compensated.

12. A display device as claimed in claim 11 wherein said one or more spacers between said screen and said magnet are substantially insulating.

13. A display device as claimed in claim 12 wherein said one or more spacers between said screen and said magnet have a low conductivity such that charge accumulation is prevented.

14. A display device as claimed in claim 12 wherein said one or more spacers between said screen and said magnet are glass ceramic.

* * * * *